United States Patent [19]

Abell

[11] 4,320,609

[45] Mar. 23, 1982

[54] GLAZING FASTENER FOR MOUNTING EITHER RIGID OR FLEXIBLE STORM WINDOWS

[75] Inventor: Irwin R. Abell, Portland, Oreg.

[73] Assignee: Hartwig-Hartoglass, Inc., Woodstock, Ill.

[21] Appl. No.: 14,149

[22] Filed: Feb. 22, 1979

[51] Int. Cl.[3] ..... A47H 13/00

[52] U.S. Cl. ..... 52/202; 52/400; 52/824

[58] Field of Search ..... 52/202, 203, 400, 788, 52/824, 827; 160/90, 180, 354, 392, 395, 394, 397, 380

[56] References Cited

U.S. PATENT DOCUMENTS

| | | | |
|---|---|---|---|
| 2,496,910 | 2/1950 | Fridolph . | |
| 2,612,947 | 10/1952 | Jenks | 52/203 |
| 2,701,041 | 2/1955 | Toth . | |
| 2,925,862 | 2/1960 | Sundby . | |
| 3;020,605 | 2/1962 | DiLemme . | |
| 3,068,939 | 12/1962 | Commisso . | |
| 3,143,165 | 8/1964 | Lewis et al. . | |
| 3,144,689 | 8/1964 | Migneault et al. . | |
| 3,187,801 | 6/1965 | Saling . | |
| 3,371,702 | 3/1968 | Keegan et al. . | |
| 3,668,830 | 6/1972 | Frank et al. . | |
| 3,932,974 | 1/1976 | Wright | 52/400 X |
| 3,991,806 | 11/1976 | Abell . | |
| 4,069,641 | 1/1978 | DeZutter | 52/202 |
| 4,164,105 | 8/1979 | Herbst | 52/202 |
| 4,189,880 | 2/1980 | Ballin | 52/202 |
| 4,233,790 | 11/1980 | Meadows | 52/716 |

FOREIGN PATENT DOCUMENTS

| | | | |
|---|---|---|---|
| 2331671 | 6/1977 | France | 52/202 |
| 2400607 | 4/1979 | France | 52/202 |
| 338957 | 7/1959 | Switzerland | 52/202 |
| 1037236 | 7/1966 | United Kingdom . | |

*Primary Examiner*—J. Karl Bell

*Attorney, Agent, or Firm*—Klarquist, Sparkman, Campbell, Leigh, Whinston & Dellett

[57] ABSTRACT

A glazing fastener for mounting either rigid or flexible storm windows employs two elongated plastic strips: a channel strip having a narrow lengthwise channel, and a glazing strip having a narrow lengthwise insert flange for insertion into the channel. Walls of the channel and sides of the insert flange have pairs of spaced apart longitudinal complementary ribs sized and positioned for interengagement. In a flexible glazing strip such ribs also enable the flexible plastic to be progressively stretched for a wrinkle-free fit. The glazing strip also has a laterally extending external flange positioned to remain outside the channel for engaging the glazing sheet, either to hold a rigid glazing sheet in place or to apply tension to a flexible glazing sheet. Various embodiments of the external flange are described including an embodiment adapted for use as an independent frame in a sliding window sash. The channel strip is oriented with respect to the window so that its channel cooperates with the shape of a selected insert flange to translate forces which would otherwise tend to separate the two strips, into a force which interlock the strips more tightly together. The channel strips are provided with means for attachment to a window frame, either a flat attachment surface or a sliding-type channel for removably mounting the fastener to a T-shaped flange on a window frame.

13 Claims, 16 Drawing Figures

FIG.8
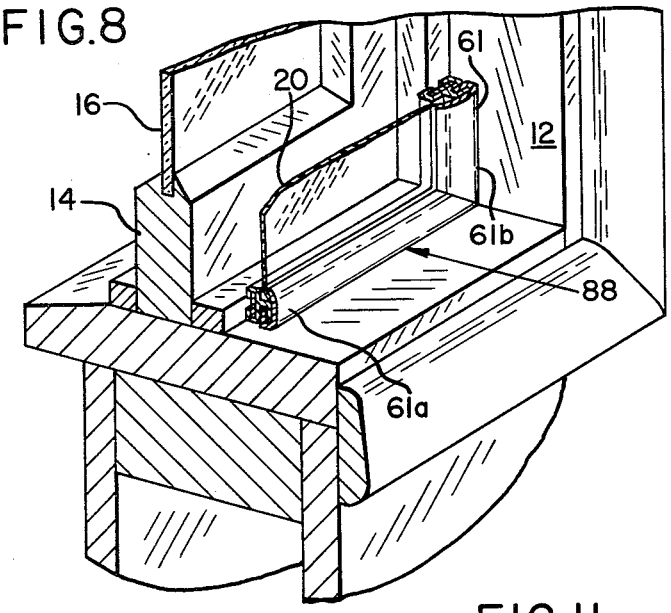
FIG.9
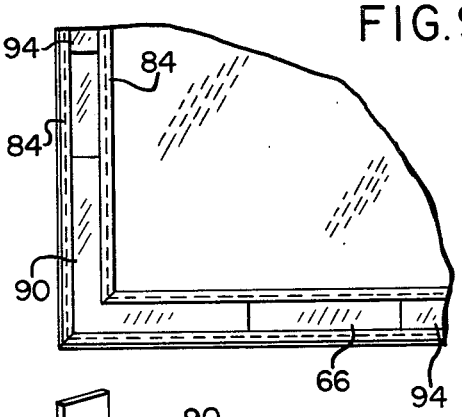
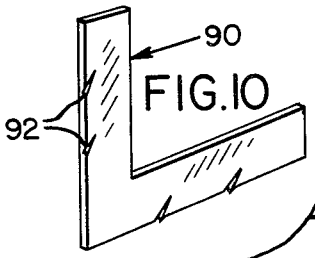
FIG.10
FIG.11
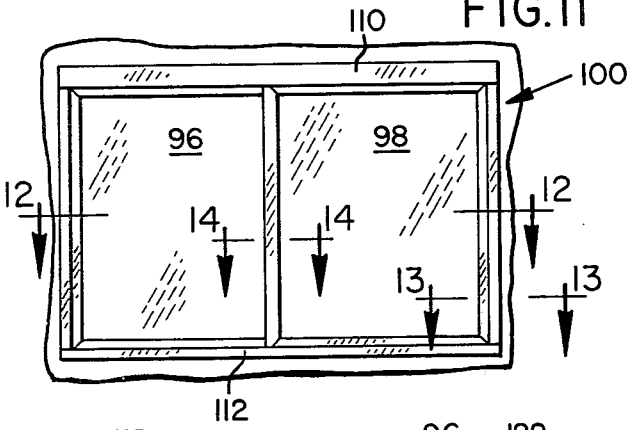
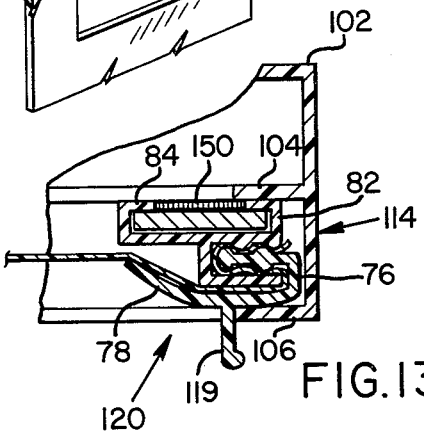
FIG.13
FIG.12
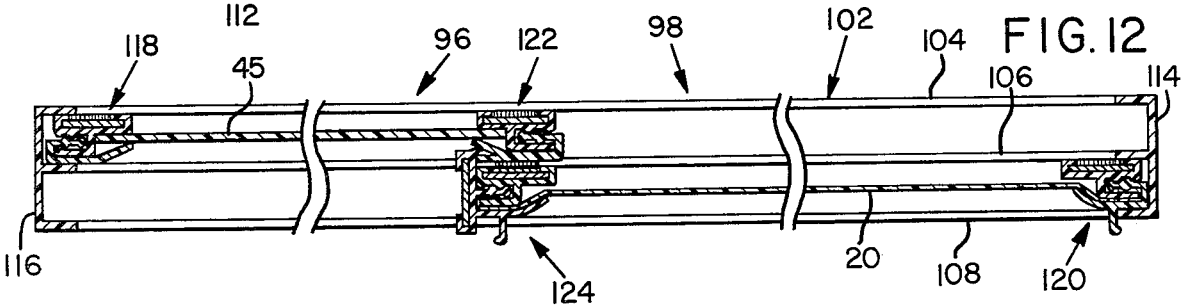
FIG.15
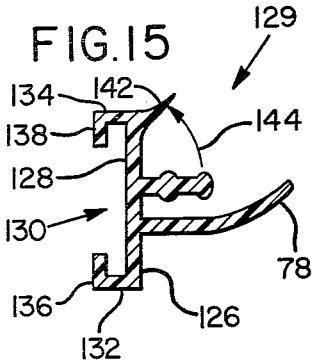
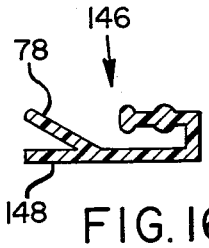
FIG.16
FIG.14
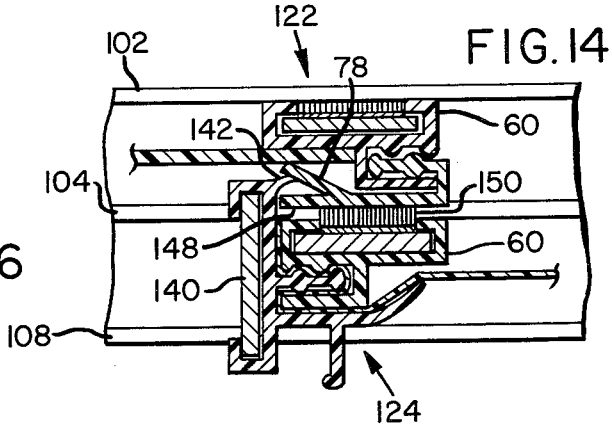

GLAZING FASTENER FOR MOUNTING EITHER RIGID OR FLEXIBLE STORM WINDOWS

CROSS REFERENCE TO RELATED APPLICATION

Reference is made to my copending patent application, Ser. No. 014,169, filed concurrently herewith, for a Double-Wall Greenhouse with Flexible Film Walls, now U.S. Pat. No. 4,274,234.

BACKGROUND OF THE INVENTION

1. Field of the Invention

The present invention relates to window glazing fasteners and more particularly to strip-type fasteners adapted for attachment to existing window frames for securing auxiliary glazing sheets at their edge.

2. Description of the Prior Art

The advantages of double glazed windows in conserving heat have long been recognized. Buildings constructed in cold climates are usually provided with permanent double-paned windows or with removable storm windows. However, many older buildings are not so equipped. In addition, with the fast rising costs of energy, it has been recognized that significant savings can be realized in heating buildings in milder climates as well. It has also been recognized that cooling costs can be reduced by using multiple pane windows.

However, the costs of retrofitting older buildings with double paned windows or with conventional storm windows is often prohibitive, forcing the owners of such buildings to seek cheaper alternatives. Conventional storm windows are also heavy and susceptible to damage during handling and storage. The alternatives most commonly used include flexible vinyl plastic or mylar films, or rigid transparent plastic panes.

Numerous types of fasteners have been designed for mounting either flexible or rigid glazings to existing window panes. Such fasteners have met varying degrees of success. One very difficult problem that has been encountered in the mounting of flexible glazing films has been to stretch the films sufficiently to obtain a wrinkle free fit. It was quickly discovered that simply nailing wooden slats around the window frame to secure the edges of plastic film was unsatisfactory.

Various types of framing strips and bead strips have been suggested for securing the edges of the film along opposite sides of a window opening. Framing strips commonly have a groove or channel for receiving a complementary shaped bead strip to secure an edge portion of the flexible film within the channel. Such an arrangement is shown in my own prior patent, U.S. Pat. No. 3,991,806 and patients cited therein. However, such fasteners either fail to stretch the fabric sufficiently to remove the wrinkles when assembled, or are unable to hold the film under sufficient tension without the bead strips pulling out of their grooves. It would be preferable if such fasteners were capable of progressively stretching the flexible film sufficiently, as the auxiliary window is being assembled, to eliminate wrinkles. In addition, it would be preferable if such fastener were capable of holding the film in place without the bead strip pulling out of the groove when the film is fully stretched.

Another problem which arises in the use of mylar type glazing films in windows is that they rattle when buffeted by gusts of wind. The principle cause of such noise is that the glazing fasteners used to date hold the film too rigidly around its edges. It would be preferable if such fasteners included some means of damping out the vibrations of such films.

Another problem is that the previous glazing fasteners have tended to be specialized for a single purpose, either for holding a rigid glazing sheet, or for holding a flexible glazing sheet, but not both. Glazing fasteners designed to secure rigid glazing sheets are disclosed in the designs of Toth, U.S. Pat. No. 2,701,041; DiLemme, U.S. Pat. No. 3,020,605; Migneault et al, U.S. Pat. No. 3,144,689; and Frank et al, U.S. Pat. No. 3,668,830. In such designs an external flange typically presses the rigid glazing against the window frame. Thus, they are designed to resist forces tending to push the glazing outwardly from the window. If such fasteners were used to secure flexible films under tension, the beads would be easily pulled from the channels. It would be preferable for the external flange, the channel and the insert portion or bead of the glazing strip to cooperate to resist both the outward forces of a rigid window glazing and the inward tension stretched flexible film glazings.

The previous flexible glazing fasteners are either unsatisfactory for stretching and holding a flexible film wrinkle-free across a window opening, or are incapable of also securing a rigid glazing. In the design of Lewis et al, U.S. Pat. No. 3,143,165, the glazing strip has an external flange extending laterally from the upper portion of the insert bead which might also be useful for securing a rigid window pane. However, that design employs only a single-lobed bead and is therefore incapable of progressively stretching flexible film adequately to obtain a wrinkle-free fit.

In U.S. Pat. No. 2,496,910, Fridolph discloses several glazing strip assemblies designed for securing the edge of fabric covering a surface. However, none of these assemblies appears to be adapted to stretching and holding a flexible glazing sheet under tension.

One such fastener employs a base strip with a channel and a capping strip with a flange portion designed for insertion into the channel together with the edge of the fabric. The flange has two longitudinal ribs along each side and the channel has a lip on each side of its entrance, but the channel is wider than it is deep, and the cross-sectional length of the ribbed flange is approximately equal to its width. Thus, although such assembly may be satisfactory for containing a margin of unstretched fabric, it would neither stretch a flexible glazing sheet adequately nor hold it in place once stretch without the capping strip being pulled from the channel. Preferably the insert flange would be longer and the channel deeper to stretch the glazing material more tightly when the glazing strip is applied. It would also be preferable for the channel to be relatively narrower over its entire length so as to obtain better frictional engagement between the surfaces of the channel and the flange. Finally, it would be preferable for the channel to have a second rib for mechanically engaging between the two ribs on at least one side of the insert flange.

Fridolph discloses another glazing fastener which employs a capping strip and a base strip each having a semi-circular channel and a flange. The flanges of each strip are rounded and positioned for insertion into the channel in the opposite strip together with the edge of the fabric. The capping strip also has a laterally extending flange for holding the fabric against the surface. Again, it is unlikely that such assembly would withstand significant tension placed on the fabric. Stretching the fabric would tend to lift the laterally extending flange causing the relatively short insert flanges to be pulled from their respective channels. It would be preferable to have a glazing fastener arranged so that such tension could be translated into a force that would cause the surfaces of the flange and channel to interengage more tightly, rather than pulling the insert flange from its channel. It would be better still if such forces would cause ribs on the flange to interlock more tightly with ribs on the channel walls.

Previous glazing fasteners typically rely on the structural rigidity of the frame or sash to which they are attached to maintain their shape. They are neither sufficiently rigid to be used as stand-alone frames, nor able to be connected together to form the corners of such frames. It would be preferable to have a glazing strip which can either be attached to existing frames or used as an independent storm window frame. It would also be preferable to have a sliding sash storm window which can be opened independently of the existing sash. Finally, it would be preferable to have a light weight, inexpensive storm window which is easily adapted to fit within spaces provided in existing window frames for conventional storm windows or window screens.

SUMMARY OF THE INVENTION

It is therefore a primary object of the invention to provide a glazing fastener which is capable of stretching and holding flexible glazing film wrinkle-free across a window opening.

A second object of the invention is to provide means for progressively stretching flexible film as it is being installed.

Another object of the invention is to provide a glazing fastener which can secure either rigid or flexible glazings across a window opening.

A further object of the invention is to better resist forces tending to separate the glazing strip from the channel.

It is also an object of the invention to translate the direction of such forces so as to cause the insert flange of the glazing strip to interlock more tightly with the channel as such forces increase.

A further object of the invention is to reduce the noise generated by vibration of flexible glazing materials stretched across a window opening.

Other objects of the invention include:

(1) Using such a glazing fastener as an independent window frame which can be substituted for conventional storm windows or used as a sliding sash window panel;

(2) Reducing the weight susceptibility to damage and cost of storm windows;

(3) Providing a variety of means of attaching such glazing fasteners either permanently or temporarily in a window frame.

A glazing fastener or apparatus according to the invention includes channel means defining a channel, and a glazing strip for securing an edge portion or margin of a glazing sheet to the channel means. The glazing strip has an insert flange adapted for insertion into the channel to join the glazing strip to the channel means. At least one of the channel side walls has two spaced-apart channel ribs extending lengthwise therealong. The insert flange has two flange ribs extending along each side and positioned for interlocking with the channel ribs. The glazing strip also has an external flange means extending laterally for engaging the glazing sheet.

The channel side walls and the sides of the insert flange can be generally parallel and are preferably dimensioned so that the length of the flange can be at least twice its thickness.

The channel can have ribs symmetrically positioned on both side walls for interlocking with symmetrically positioned flange ribs.

One channel rib can be positioned near the entrance to the channel and the second rib can be positioned intermediate the first rib and the bottom of the channel. The flange ribs can be positioned to fit just below the channel ribs.

The glazing strip can be formed of resilient material so that it can be bent for progressive stretching of flexible plastic film and so that the insert flange can be squeezed between the channel ribs. It can also be formed of semi-rigid material for use with glazings that need not be progressively stretched.

The channel means can be a channel formed directly in the frame to which the storm window is to be fitted, or it can be a separate channel strip having attachment means for attaching the strip to an existing surface. The attachment means can be a flat surface suitable for nailing or glueing, or slide fastener means, such as a channel, adapted for sliding onto a track.

The external flange means can be one or two flanges extending in opposite directions from the top of the insert flange. One flange can have an extension flange or skirt angled toward the insert flange to engage the glazing.

The channel can be oriented so that its sides parallel the glazing and its entrance is directed away from the window opening. The extension flange is angled so as to generally parallel to the insert flange and has a curved portion overlapping one side wall of the channel and engaging the glazing.

In the last described configuration, use of a channel as slide fastener means enables multiple such channel strips, preferably formed of semi-rigid material, to be joined at angles to form sash frame members of an independent window frame. An L-shaped member adapted to fit in the channel can be used to join channel strips at right angles. Straight members can also be inserted into the channel to reinforce the frame member against the stretched glazing.

The glazing strip can be made of rigid plastic to provide additional reinforcement. A flange or a channel like that of the slide fastener means can be added to the glazing strip to provide further reinforcement.

Two such independent window frames can be used as sliding sashes adapted for sliding between inwardly opposed channels. An air tight fit is obtained between two adjacent sash frame members by providing a tapered flange in one glazing strip, which is directed toward the external flange of the glazing strip of the adjacent sash frame member so that the tapered flange flexibly engages the outer curved face of the external flange when the windows are closed.

These and other objects, advantages and features of the invention will become more apparent from the following detailed description of preferred embodiments of the invention which proceed with reference to the drawings.

BRIEF DESCRIPTION OF THE DRAWINGS

FIG. 8 is a perspective view of the window of FIG. 1 employing the embodiment of FIG. 7 as an independent storm window.

FIG. 9 is a rear plan view of the storm window of FIG. 8 showing its assembly about a corner joining member.

FIG. 10 is a perspective view of the joining member of FIG. 9.

FIG. 11 is a front plan view of two window panels employing the embodiment of FIG. 7 as sash frames for sliding windows.

FIG. 12 is a cross-sectional view taken along the line 12—12 in FIG. 11.

FIG. 13 is an enlarged fragmentary cross-sectional view taken along line 13—13 in FIG. 11.

FIG. 14 is an enlarged fragmentary cross-sectional view taken along line 14—14 of FIG. 11, and showing a modification of the FIG. 7 embodiment.

FIGS. 15 and 16 are enlarged cross-sectional views of the glazing strips of the modified FIG. 7 embodiment of FIG. 14.

DETAILED DESCRIPTION OF PREFERRED EMBODIMENTS

Figure 1:
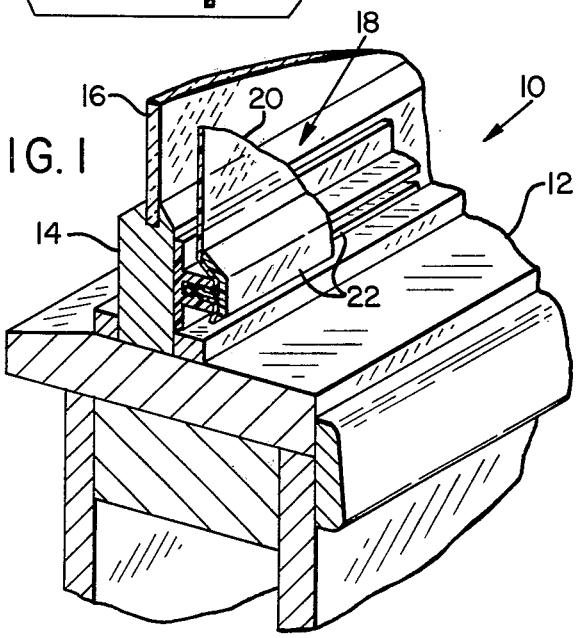
FIG. 1 is a fragmentary perspective view of an existing window frame, sash and window pane in which one embodiment of the glazing apparatus of the present invention secures a storm window to the sash.

In FIG. 1 a conventional window 10 has a frame 12, a sash 14 and a window pane 16. An auxiliary or storm window 18, having a flexible glazing sheet 20, such as vinyl plastic or mylar film, is attached to the sash by a glazing apparatus 22. The glazing apparatus has a uniform cross-section over its entire length.

FIG. 2 Embodiment

Figure 2:
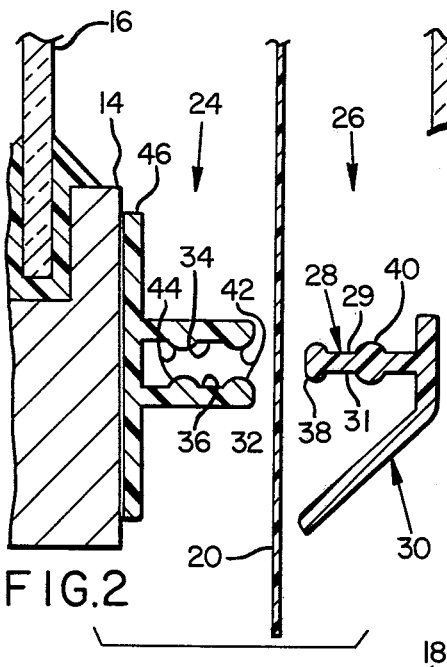
FIG. 2 is an exploded cross-sectional view of the glazing apparatus of FIG. 1 attached to the sash.

Referring to FIG. 2, the glazing apparatus includes a base or channel strip 24 and a glazing strip 26. The glazing strip 26 has an insert flange or bead 28 and a laterally extending external flange 30 connected to the top of the insert flange. The channel strip has two parallel opposed side walls 34, 36, spaced apart and of sufficient depth to define a channel 32 for receiving insert flange 28. The insert flange has generally parallel sides 29, 31.

The insert flange has two lengthwise extending, parallel ribs on each side. The first pair of flange ribs 38 is symmetrically positioned along the edge of insert flange 28 opposite the external flange 30. The second pair of ribs 40 is symmetrically positioned along the insert flange intermediate ribs 38 and the external flange. The ribs are spaced apart from one another and from the external flange a distance slightly greater than their width. The intermediate ribs 40 are positioned slightly closer to the external flange than to edge ribs 38.

The channel also has two lengthwise-extending parallel ribs on each side wall. The first pair of channel ribs 42 is positioned just inside the entrance to channel 32. The second pair of ribs 44 is positioned intermediate the first ribs and the bottom of the channel. Like the flange ribs, the channel ribs are spaced apart slightly more than the widths of the ribs, but the intermediate ribs are closer to the bottom of the channel than to the channel entrance. Both the channel ribs 42, 44 and the flange ribs 38, 40 are generally rounded to minimize damage to the flexible film glazing 20.

Figure 3:
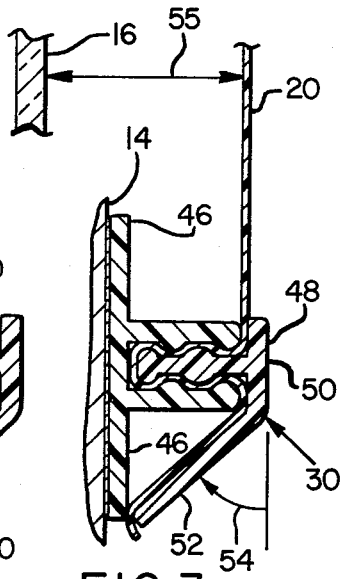
FIG. 3 is a cross-sectional view of the FIG. 2 embodiment assembled with a flexible glazing sheet.
Figure 4:
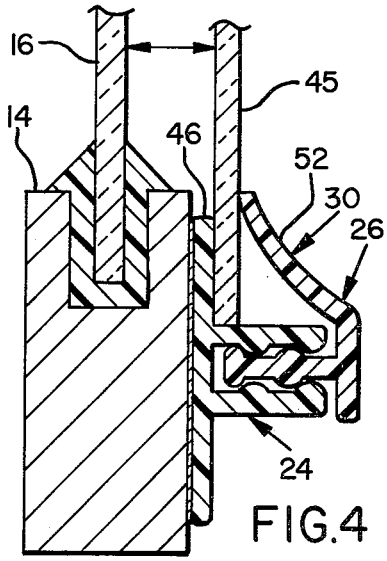
FIG. 4 is a cross-sectional view of the FIG. 2 embodiment assembled with a rigid glazing sheet.

Referring to FIGS. 3 and 4, the channel insert flange and their respective ribs are dimensioned so that the channel is narrower at its ribs than the cross-sectional width of the flange measured across its ribs, but is slightly wider than the width of the flange measured between the channel walls 34 and 36. These proportions permit the glazing strip to be inserted into the channel with a flexible glazing sheet 22 in the channel, as shown in FIG. 3, and yet fit tightly enough to stay in the channel without requiring a glazing sheet, as in FIG. 4.

The amount that the glazing material is stretched is determined primarily by the length of the insert flange. The longer the insert flange the better it will stretch the material. When the fastener is used to secure a rigid window pane 45, as shown in FIG. 4, the outward pressure of the pane against the external flange 30 causes the insert flange to pivot slightly within the channel. This causes the flange ribs 38, 40 to diagonally interlock with the channel ribs 42, 44. However, the benefits of such interlocking are reduced as the flange is lengthened in proportion to the width of the channel. Therefore, the length of the flange should be between approximately two and three times the width of the channel measured between walls 34 and 36. Preferably, the cross-sectional length of the insert flange is about 2.5 times the width of the channel. The channel is similarly proportioned to receive the insert flange.

Figure 5:
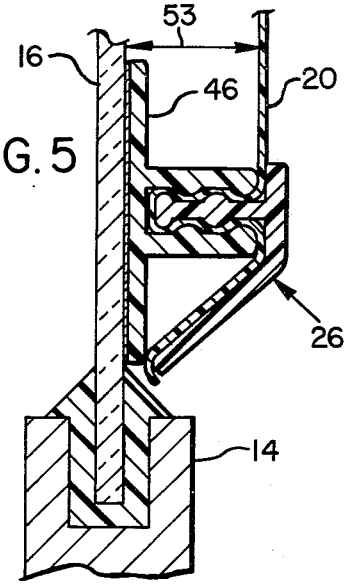
FIG. 5 is a cross-sectional view of the FIG. 2 embodiment attached to the window pane.
Figure 6:
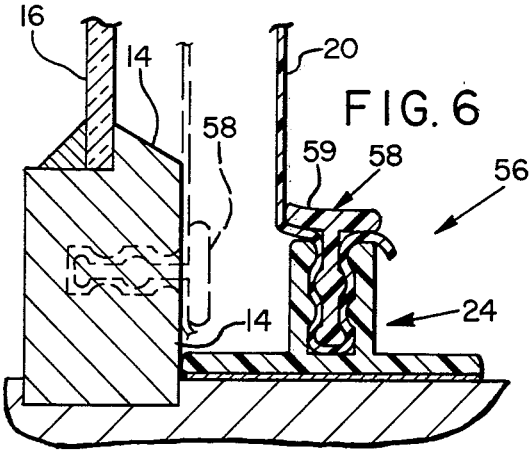
FIG. 6 is a cross-sectional view of a second embodiment of the present invention attached to the sill of an existing window frame.

The channel strip 24 has a flat, laterally-extending base 46 providing means for attaching strip 24 to a sash 14 and forming the bottom of channel 32. Strip 24 can be attached by glue, nails, screws and other common means appropriate to the material to which it will be attached. The glazing apparatus can be glued directly to a window pane 16, as shown in FIG. 5, or attached to the window frame 12, as shown in FIG. 6, as well as to the sash.

Referring to FIG. 3, the external flange 30 of strip 26 includes two flanges 48, 50 extending approximately at right angles in opposite directions from the insert flange to define a T-shaped cross-section. Although formed at right angles, such angles may vary since the glazing strip tends to be resiliently deformed when the glazing apparatus is used. Flange 50 has a second flange or skirt 52 connected to the edge of flange 50 at an angle directed toward the insert flange, as indicated by arrow 54. Such angle can vary between about 45° and 75°, but is preferably about 60°.

Channel strip 24 is made of rigid material, preferably extruded polyvinyl chloride (PVC-rigid). Glazing strip 26 is made of a more flexible material, such as PVC-90 durometer, so that it can be resiliently deformed for assembling the glazing apparatus.

In FIG. 3 the glazing apparatus of FIG. 2 is assembled with a margin of flexible glazing 20 compressed between the channel walls and the sides of the insert flange. Skirt 52 covers the loose edge of the glazing to present a neat external appearance and yet leave sufficient excess material along the margin so that the glazing material can be more easily removed and reinstalled with the change of the seasons.

In FIG. 4, the glazing apparatus of FIG. 2 is assembled with the position of the skirt 52 relative to the window reversed. Thus assembled, skirt 52 engages the outer surface of the rigid glass or plastic pane 45 and flexibly presses it against base 46.

In FIG. 5 the glazing apparatus of FIG. 2 is glued to window pane 16 to reduce the distance between the window pane and the flexible glazing (indicated by arrow 53) from the distance indicated in FIG. 3 by arrow 55, thereby reducing the extent that glazing 20 protrudes from the window.

FIG. 6 Embodiment

In FIG. 6 a second glazing apparatus 56 includes a channel strip 28, like that of FIG. 2, and a glazing strip 56. The glazing strip 58 is similar to strip 26 in FIG. 2, differing only in that skirt 52 of strip 26 has been omitted. Omission of the skirt further reduces the cost of the glazing apparatus and provides a means for securing a flexible glazing 20 directly to the window sill with an external flange 59 flexibly engaging glazing 20. It can also be inserted into a channel formed directly in the frame of sash 14 to hold a flexible glazing flush against the surface of the frame as shown in phantom lines in FIG. 6. Such use of glazing strip 58 to attach flexible glazing to channels formed in the frame of a greenhouse is described in my above-reference copending patent application.

The FIG. 2 and FIG. 6 Embodiments can both be used to progressively stretch a plastic or other flexible film glazing as it is being assembled. The window is prepared by cutting four pieces of channel strip 24 to the lengths required to frame the window. The channel strips are preferably cut at 45° angles to form a mitered corner. The channel strips are then attached to the window frame. Next, a sheet of glazing material is cut to a size slightly larger than the window opening, and taped in an approximately centered position over the frame.

The glazing strips, cut to lengths corresponding to the lengths of the channel strips, are inserted in accordance with the following steps.

(1) Press the insert flange of a first strip into the channel at the top center of the window, together with a portion of the glazing sheet, beginning at the center and progressing in opposite directions until approximately eight inches of the strip has been inserted halfway into the channel; that is, to the depth of the first ribs.

(2) Stretch the sheet down and press a second strip into the channel at the bottom center of the window in the manner of the previous step.

(3) Insert a third strip into the channel on one side in the manner of the first step, then stretch the sheet toward the opposite side as described in the second step and insert the fourth glazing strip.

(4) Return to the first strip and press the rest of it into the channel to the depth of the first ribs. This step is repeated for each of the other strips, in each case working from the center toward each corner.

(5) Once the strips have been pressed halfway into the channel as described above, step (1) through (4) are repeated, pressing each strip into the channel to its full depth; that is, to the depth of the second ribs.

The excess material can then be trimmed off along the edges of the external flanges.

FIG. 7 Embodiment

Figure 7:
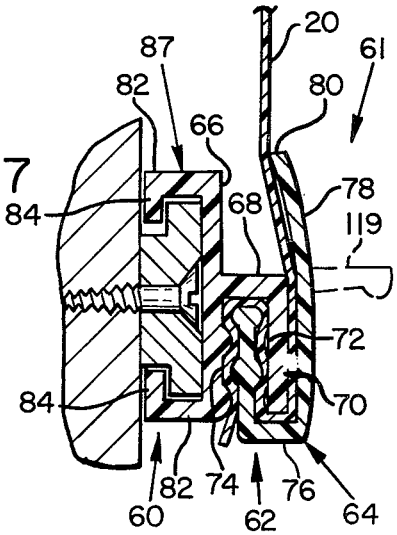
FIG. 7 is a cross-sectional view of a third embodiment of the present invention mounted on a track on a window frame.

In FIG. 7 glazing fastener 61 employs a channel strip 60 in which the channel is positioned with its walls parallel to the glazing sheet and with its entrance directed outwardly from the window. The glazing strip 62 is adapted to channel strip 60 by a unique arrangement of its external flange 64, described in detail hereinafter. Strips 60, 62 are preferably made of semi-rigid plastic (PVC-rigid).

The channel strip has a base 66 extending laterally in opposite directions from a central flange 68. A channel flange 70 extends at a right angle from the central flange to define an outer channel side wall 72. It parallels a portion of base 66 which defines an inner channel side wall 74. Flange 68 forms the bottom wall of the channel. The inner side wall includes two parallel lengthwise-extending ribs.

The glazing strip has a ribbed insert flange like those of the FIG. 2 and FIG. 6 Embodiments. However, its external flange 64 has a first portion 76 normal to the insert flange and a second portion or flange 78 extending from the first portion at about a right angle toward the insert flange so as to overlap channel flange 70. In addition, the second portion is further curved or angled toward the insert flange so that its edge 80 is approximately aligned with the centerline of the insert flange.

Edge 80 is thus positioned to flexibly engage a side of a glazing sheet, which can be a flexible glazing 20, or a rigid glazing 45 (FIG. 12). The FIG. 7 embodiment is especially useful for mounting semi-rigid mylar film since flange portion 78 tends to damp out the vibrations which would otherwise cause a rattling noise.

The channel strip has a second channel whose bottom wall is fanned by base 66 and whose side walls are formed by flanges 82 extending at right angles from base 66. Flanges 82 have lips 84 extending toward each other to wrap around opposite sides of a track 86, the track being mounted to the window frame or sash.

The second channel thus defines a slide fastener means 87 for slidingly engaging a track so that the storm window can be easily removed without dismantling the glazing fastener. The slide fastener means can be incorporated into base 46 (FIGS. 1–7) as well. However, in glazing fastener 61, it serves other purposes described hereinafter.

Referring to FIG. 8, an independent storm window 88 includes four lengths of glazing fastener 61 connected at mitered corners to form a sash frame about flexible glazing 20. Window 88 can be sized to easily fit in the space within a window frame that would ordinarily be occupied by a conventional storm window, but provides a light weight, inexpensive substitute.

In FIG. 9, sash members 61*a*, 61*b* which are lengths of the glazing fastener 61, are joined at a corner by an L-shaped joining member 90, better seen in FIG. 10. Member 90 has a rectangular cross-section shaped to fit tightly in the channel of the slide fastener means 87. It has barbs 92 along its edges to resist removal of member 90 from the channels. Such barbs can be applied by scoring the member, which is preferably metal, along its edge with a cold chisel.

Sash members 61*a*, 61*b* are reinforced by straight, reinforcing bars 94, also formed of metal. The reinforcing bars are preferably used if the dimension of the storm window are larger than about two feet, and stretched flexible glazing is used. Like member 90, the reinforcement bars are shaped to fit tightly in the second channel and can be provided with barbs 92 so that they will not move once they are positioned.

Referring to FIG. 11, two sliding sash storm windows 96, 98 are positioned within a frame 100. Windows 96, 98 are similar to window 88 (FIG. 8) except for certain differences described hereinafter.

Frame 100 includes frame members whose parallel lengthwise-extending flanges 104, 106 and 108 define side walls of two frame channels. Windows 96, 98 extend vertically between upper and lower frame members 110, 112 and slide from side to side between frame members 114, 116.

Referring to FIG. 12, vertical sash member 118 at the left side of the window is the glazing fastener 61 of FIG. 7, but is reinforced as discussed above with reference to FIG. 9. Vertical sash member 120, at the right side of the window, is similar to member 118, but has a flange 119 extending normal to flange 78. Flange 119 reinforces the sash member in the plane normal to the glazing 20 and also serves as a slide handle. The horizontal sash frame members are substantially identical to member 118.

At the center of the window, sash frame member 122 of window 96 is positioned in side-by-side abutting relationship with member 124 of window 98.

In FIG. 4 members 122, 124 are modified forms of glazing fastener 61 (FIG. 7). Members 112, 124 use identical channel strips 60 but the channel strip in member 122 is oriented in a direction opposite that of member 124. In addition, two modified glazing strips are used.

Referring to FIG. 15, sash frame member 124 has a glazing strip 129 which differs from strip 62 (FIG. 7) in that the first portion of the external flange has lateral extensions 126, 128, normal to the insert flange. Such extensions define the base of a reinforcement channel 130. Flanges 132, 134 extend from the lateral extensions in a direction opposite the insert flange to define side walls of channel 130. Inwardly extending lips 136, 138 partially enclose the channel for receiving a reinforcement member 140 (FIG. 14). Extensions 126, 128 and member 140 reinforce the center of the window in the plane normal to the glazings.

A tapered flange 142 extends from the corner between lateral extension 128 and flange 134 at an angle of, for example, approximately 45° away from the insert flange, as indicated by arrow 144.

Referring to FIG. 16, sash frame member 122 has a glazing strip 146 which differs from strip 62 (FIG. 7) in that the second portion of the external flange has a straight extension flange 148 which diverges from the angled or curved portion of flange 78.

In FIG. 14 the tapered flange extends generally toward member 122 and flexibly engages the outer surface of flange 78 along one side to form a tight air seal between member 122 and 124. Extension flange 148 engages the opposite side of tapered flange 142 near its base to interlock frame members 122 and 124 so that member 122 is reinforced by member 124. Extension flange 148 also forms a stop against which the face of lateral extension 128 adjacent the tapered flange abuts when the windows are closed to prevent breaking the tapered flange.

Referring to FIGS. 7 and 13, the surface of first portion 76 juts out from the surface of flange 82 to present a narrow sliding surface at the bottom of the channel. Such a narrow surface makes it easier to slide the sashes in their channel and enables nails or staples to be used beneath flange 82 for mounting the frames in the window opening.

The corner between the first and second portions 76, 78 is rounded in conformity with the curvature of flange 78. Thus, when the window is closed, the rounded corner is guided easily beneath flange 106 in frame member 114. The frame members are made of semi-rigid plastic (PVC-rigid). Thus flange 106 flexibly engages the surface of flange 78 to obtain a tight air seal at opposite ends of the window. Weather strip material 150 in the slide fastener channels 87 of both the vertical and horizontal sash members completes the air seal.

Having illustrated and described a preferred embodiment of the invention, it should be apparent to those skilled in the art that the invention may be modified in arrangement and detail.

I claim as my invention all such modifications as come within the true spirit and scope of the following claims:

1. A glazing fastener apparatus, for securing a glazing sheet across a window opening, comprising:

channel means defining an elongated channel having two inwardly opposed side walls connected by a channel bottom wall, at least one of said side walls including a pair of spaced-apart, generally rounded channel ribs extending lengthwise therealong;

glazing strip means for securing an edge portion of said glazing sheet to said channel means, said strip means having:

a single insert flange for insertion into said channel, said flange having opposite sides, each with a pair of generally rounded flange ribs extending lengthwise therealong in spaced-apart positions for interlocking with said channel ribs when said insert flange is inserted within said channel; and an enternal flange means extending laterally from an outer portion of said insert flange for engaging said glazing sheet;

said channel ribs and flange ribs being spaced apart a depthwise distance at least as great as the width of said ribs;

said insert flange being sized relative to the channel to provide just enough clearance for insertion into the channel along with a flexible glazing sheet and being sufficiently rigid that, without a flexible glazing sheet in the channel, the insert flange diagonally positions in the channel to interengage one flange rib and an adjacent channel rib to secure a rigid glazing sheet under the external flange means; and the channel means and insert flange being sufficiently resilient that the insert flange and flexible glazing can be inserted into the channel without cutting the flexible glazing between said ribs;

such that said glazing fastener can be used interchangeably to secure both rigid and flexible glazing sheets across a window opening.

2. Apparatus according to claim 1, in which said channel side walls are generally parallel and said insert flange sides are generally parallel.

3. Apparatus according to claim 1, in which a first said channel rib is positioned near the entrance to said channel and a second said channel rib is positioned approximately intermediate said first channel rib and said channel bottom.

4. Apparatus according to claim 1, in which a first said flange rib is positioned to fit between said channel ribs and a second said flange rib is positioned just below the lower of said channel ribs.

5. Apparatus according to claim 1, in which said channel-defining means includes a channel strip;

one of said glazing and channel strips including attachment means for attaching said strip in a window opening.

6. Apparatus according to claim 5, in which said attachment means includes slide fastener means for slidingly engaging a track so that said strip can be removably attached about said window frame.

7. Apparatus according to claim 1, in which said external flange means includes a first flange normal to said insert flange.

8. Apparatus according to claim 7, in which said flange means includes a second flange connected to said first flange opposite said insert flange, the second flange being angled from the plane of said first flange toward said insert flange.

9. Apparatus according to claim 8, in which the side walls of said channel lie in planes parallel to said window opening and its entrance is directed outwardly from said window opening;

said second flange being angled so as to generally parallel said insert flange and being curved so that it overlaps one of said channel side walls and engages said glazing sheet.

10. Apparatus according to claim 1, in which the depth of said channel is between two and three times its width, the dimensions of said insert flange being sufficiently less than those of said channel that a flexible glazing sheet can be inserted into the channel together with the insert flange to the full depth of said flange to stretch said flexible glazing sheet.

11. Apparatus according to claim 1, in which said channel means is a channel strip which consists of rigid plastic material and the insert flange of said glazing strip means consists of elastic plastic material of about 90 durometer hardness so that the ribs of said insert flange means can be compressed sufficiently to permit passage of the rounded insert flange ribs and said flexible glazing sheet between the rounded ribs of said channel walls without cutting the glazing sheet.

12. A glazing fastener apparatus, for securing a glazing sheet across a window opening, comprising:

channel means defining an elongated channel having two inwardly opposed side walls connected by a channel bottom wall, each of said side walls including a pair of spaced-apart generally rounded channel ribs extending lengthwise therealong;

glazing strip means for securing an edge portion of said glazing sheet to said channel means, said strip means having:

an insert flange for insertion into said channel, said flange having opposite sides, each with a pair of generally rounded flange ribs extending lengthwise therealong in positions for interlocking with said channel ribs when said insert flange is inserted within said channel; and an external flange means extending laterally from an outer portion of said insert flange for engaging said glazing sheet;

the depth of said channel being at least twice its width, the depth of said insert flange being at least twice the width of said channel and the width of the channel being sufficiently greater than the width of the insert flange that a flexible glazing sheet can be inserted into the channel along with insert flange and held therebetween, the ribs enabling the flexible glazing sheet to be stretched in two steps by an amount corresponding to the depth of the insert flange;

the channel means being resiliently rigid and the glazing strip means having a hardness of about 90 durometer so as to be compressible enought to permit passage of the insert flange ribs and the flexible glazing sheet between the channel ribs without cutting the glazing sheet but sufficiently rigid that pivoting diagonally opposite flange ribs against opposite channel walls below the channel ribs, without a flexible glazing sheet therebetween, increases the interengagement of said ribs to resist removal of the insert flange from the channel and for holding a rigid glazing sheet under the external flange means.

13. Apparatus according to claim 1 or 12 in which the external flange means is configured to translate a force exerted by the glazing sheet against the external flange means in a direction parallel to the depth of the channel into a rotational force such that the insert flange pivots in the channel to increase the interengagement of said ribs.

* * * * *

UNITED STATES PATENT AND TRADEMARK OFFICE

CERTIFICATE OF CORRECTION

PATENT NO. : 4,320,609

DATED : March 23, 1982

INVENTOR(S) : Irwin R. Abell

It is certified that error appears in the above-identified patent and that said Letters Patent are hereby corrected as shown below:

Column 1, line 53, "patients" should be--patents--;
Column 9, line 31, "FIG. 4" should be--FIG. 14--;
Column 9, line 32, "112" should be--122--;

Column 12, line 32, "enought" should be--enough--;

Signed and Sealed this

Twentieth Day of July 1982

[SEAL]

Attest:

GERALD J. MOSSINGHOFF

Attesting Officer

Commissioner of Patents and Trademarks